United States Patent [19]

Thompson

[11] Patent Number: 4,842,035

[45] Date of Patent: Jun. 27, 1989

[54] SPACE DIVIDER AND FRAMING MEMBERS THEREFOR

[75] Inventor: Owen Thompson, Oak Park, Ill.

[73] Assignee: Singer Safety Company, Chicago, Ill.

[21] Appl. No.: 75,625

[22] Filed: Jul. 20, 1987

[51] Int. Cl.[4] ..... A47G 5/00

[52] U.S. Cl. ..... 160/135; 160/351

[58] Field of Search ..... 160/135, 351, 372, 374, 160/374.1; 248/188.8, 165; 40/605, 606, 607, 610

[56] References Cited

U.S. PATENT DOCUMENTS

| | | | |
|---|---|---|---|
| 2,357,819 | 9/1944 | Greer | 160/351 |
| 2,571,382 | 10/1951 | Raven | 160/351 X |
| 3,428,108 | 2/1969 | Singer . | |
| 3,502,330 | 3/1970 | Cheftel | 160/371 |
| 3,583,466 | 6/1971 | Dreyer | 160/351 |
| 4,063,585 | 12/1977 | Stanley | 160/135 |
| 4,085,789 | 4/1978 | Steiner et al. | 160/135 |
| 4,134,439 | 1/1979 | Scott | 160/135 |
| 4,465,262 | 8/1984 | Itri et al. | 160/374 X |

FOREIGN PATENT DOCUMENTS

| | | | |
|---|---|---|---|
| 528142 | 10/1940 | United Kingdom | 160/351 |
| 2081338 | 2/1982 | United Kingdom | 160/351 |

OTHER PUBLICATIONS

Singer Safety Products, Inc., Catalog No. 502, 1973, pp. 1–8.

Steiner Industries Catalog 201, 1985, pp. 16–19.

*Primary Examiner*—Ramon S. Britts

*Assistant Examiner*—David M. Purol

*Attorney, Agent, or Firm*—Lockwood, Alex, Fitzgibbon & Cummings

[57] ABSTRACT

A free standing screen-like space divider which is portable is provided particularly for use as a welding screen and which may consist of one or more sections with plural sections being pivotally interconnected, the divider frame including improved and versatile framing members. The framing members include corner frame members which are of tubular configuration having first and second tube portions positioned at right angles to one another and provided with outwardly projecting threaded nuts fixed to outer surfaces of the tube portions adjacent opposite ends thereof and surrounding openings in the tube portions, which openings are aligned with the threaded portions of the nuts to receive thumb screws therethrough into the interior of the tube portions to engage and releasably fix another tube-like member forming a part of the frame and being telescopically received within the tube portions.

15 Claims, 2 Drawing Sheets

SPACE DIVIDER AND FRAMING MEMBERS THEREFOR

BACKGROUND AND DESCRIPTION OF THE INVENTION

The present invention is directed to an improved space divider and, more specifically, improved framing members, particularly corner framing members. Many different forms of frames for free-standing and portable space dividers have been proposed. Generally, such dividers are screens having rectangular metal frames supporting the screening material and provided at the bottom thereof with floor supporting platforms or legs. Space dividers of this type frequently include a plurality of frame supported screens which are pivotally interconnected to permit folding for portability or storage as well as permitting variation in the shape of the space or area to be screened.

Certain uses of space dividers necessitating frequent movement of the divider from one location of use to another, as well as versatility in variation of divider size to accommodate areas of use of varying dimensions, require substantial versatility in frame member design and functioning. Space divider application for screening an area in which welding is being carried out is a prime example of a most demanding use of a space divider. Welding screens per se have been known for many years and welding screens exhibiting a wide variation in design of frame members are currently available. One of the most successful frames for use in a welding screen has involved the provision of right-angled corner frame members of tubular configuration having threaded openings in the opposite ends for advancing and retraction of a set screw against or away from a straight side frame telescopically received in the opposite ends of the corner frame members. Additionally, a pair of corner members have been pivotally interconnected by use of a double collar or sleeve hinge member which movably surrounds the tubular ends of adjacent portions of the corner members. Bosses have been provided in the corner members adjacent opposite ends of the double collar hinge members to limit axial sliding movement of the hinge member along the tube portions of the corner members.

While the foregoing type of frame member construction has been substantially successful in meeting the many requirements of a welding screen, the formation of threaded openings in the tubular end portions, particularly when combined with the simultaneous formation of a boss, has proven somewhat expensive. Additionally, relying on a boss of limited area to confine the sleeve of a hinge member on the tubular portion of a corner frame member can on occasion lead to inconvenient binding of the hinge member on the tube portion thereby interfering with efficient use of the screen.

It has been found that, in accordance with the present invention, the use of separate threaded nut means, preferably in the form of standard weld nuts, mounted, such as by welding, adjacent each end of a corner or primary frame member with the threaded opening of the nut in alignment with an opening or hole formed through the tube portion of the frame member so that a set screw may be threadedly advanced into and threadedly retracted out of the interior of the tube portion, greatly enhances the assembly, disassembly and functional operation of a frame for a space divider, such as a welding screen. Still further, it has been found preferable to provide a circumferentially continuous boss of well-defined shape in spaced relation to the weld nut to capture a pivotal collar of a double collar hinge member therebetween when a plurality of frames are hingedly interconnected for space dividing purposes. The weld nut and preferred continuous boss establish positive bearing surfaces which not only confine the collar of the hinge member on the tube portion of the corner frame member, but also bear against opposite ends of the collar as becomes necessary during pivoting of one fame member relative to another in a positive manner that prevents binding.

These features, as well as others to be more specifically defined hereinafter, provide an improved space divider and frame members therefor, the frame members being readily assembled and disassembled without the need for use of tools thereby improving versatility, portability and storage. Other advantages will become apparent from the following description of the preferred embodiment of the invention.

SUMMARY OF THE INVENTION

A space divider is provided that is particularly suitable for use as a welding screen including a frame formed from primary and secondary frame members, the primary frame members constituting corner frame members of tubular right angled configuration having at opposite ends thereof an attached and projecting threaded nut in alignment with an opening through the adjacent tube surface, and a thumb screw is mounted therein for threaded advancement and retraction into and out of the interior of the adjacent tubular portion. Certain of the corner frame members designed for pivotally interconnecting at least a pair of frame members are further provided with a tubular collar of a double collar hinge member adjacent one end so as to be confined between bearing surfaces defined by the nut and the boss, whereby a pair of corner frame members may be pivotally interconnected without binding to form adjacent relatively movable screen sections.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

Figure 1:
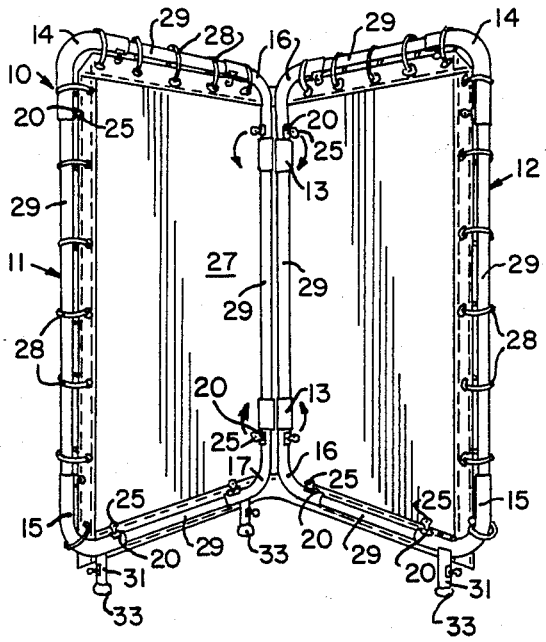
FIG. 1 is a perspective view of a double section screen having a pair of frames pivotally interconnected and illustrating utilization of the invention.

FIG. 1 shows an assembly 10 of a pair of space dividers including the improved framing members of the present invention. The space dividers to be described hereinafter are in the form of welding screens, but it will be apparent that the principles of the invention are equally applicable to any form of free-standing, portable space divider for decorative or privacy use in the home, office, hospital or the like. In referring specifically to a welding screen, it will be borne in mind that such screens are useful in connection with many different types of operations, including cutting and brazing, welding, spraying, equipment isolation, worker isolation and draft control. Such screens, in the form of single or multiple section, establish a safety area for the worker, supervisor and/or equipment. Such a safety area may be inside or outside the screen.

In the embodiment of FIG. 1, a pair of frames 11 and 12 are arranged in side-by-side relation with the adjacent vertical portions of the frames being pivotally interconnected by hinge assemblies 13 which are in the form of double collars to be described. Basically, each frame 11 and 12 of the screen 10 includes a corner frame member 14 of the type illustrated in FIG. 3, another form of corner frame member 15 of the type illustrated in FIG. 4, still another form of corner frame member 16 illustrated in FIG. 5, and a slightly modified form of corner frame member 17 illustrated in FIG. 6. Each corner frame member is of tubular configuration having tube portions bent relative to one another at right angles and thus including, as illustrated, a vertically directed tube portion 18 and a horizontally directed tube portion 19. Adjacent the outer end of each tube portion 18 and 19, each corner frame member is provided with an attached threaded nut 20, preferably of the type commonly known as a weld nut.

Figures 2, 5, 7:
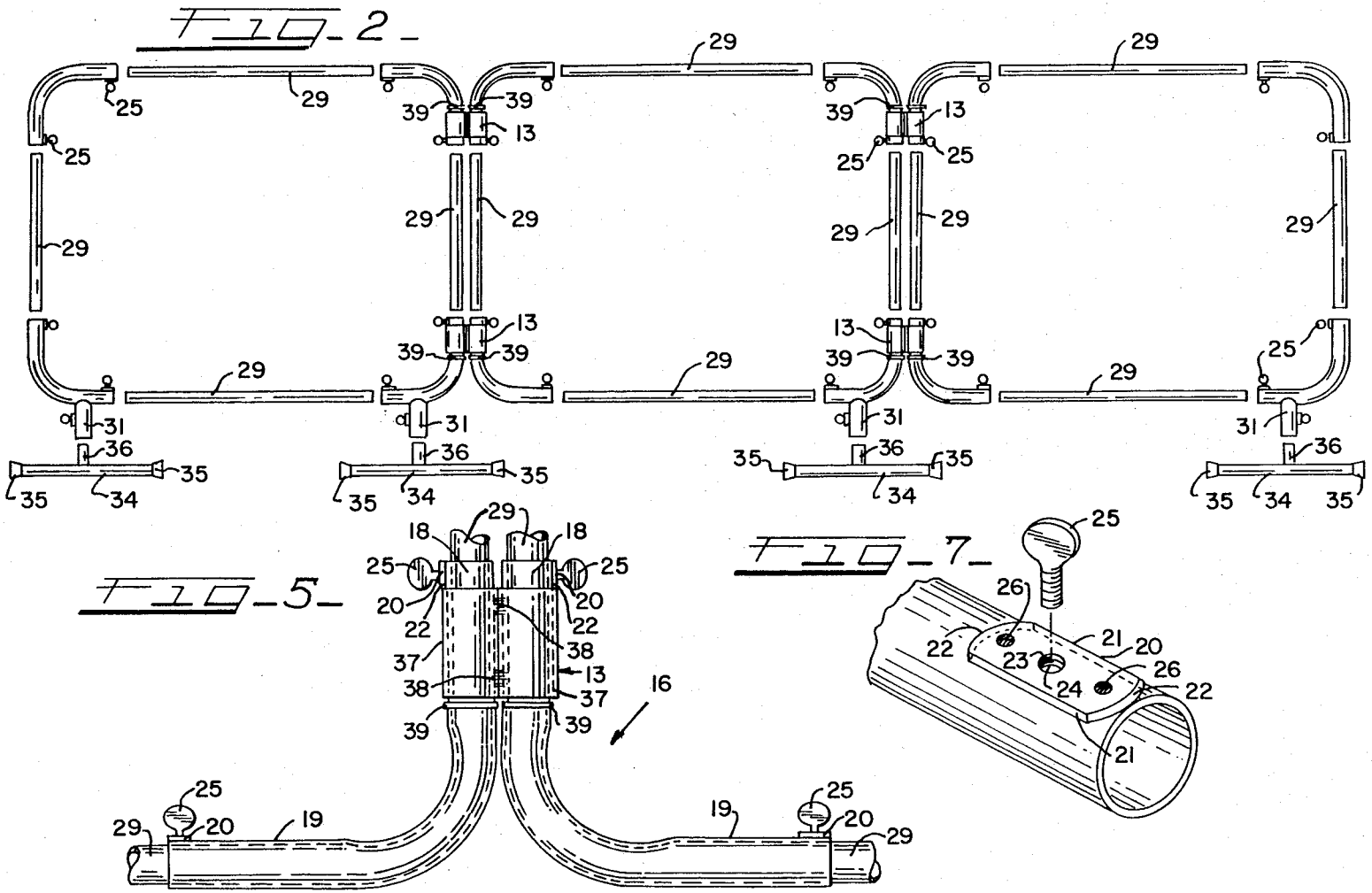
FIG. 2 is an exploded elevational view of a plurality of frames incorporating the features of the present invention to illustrate assembly and disassembly of the various frame members of the present invention.
FIG. 5 is a view similar to FIG. 3 illustrating the pivotal interconnecting of a pair of corner frame members of FIG. 3 in accordance with the principles of the present invention.
FIG. 7 is an enlarged fragmentary perspective view of one end of a corner frame member illustrating the position of a weld nut thereon and illustrating the alignment of a thumb screw therewith.

As best illustrated in FIG. 7, weld nut 20 is formed from a small flat bar of steel which is of generally rectangular shape. The sides 21 of the bar are straight while the opposite ends 22 define convex bearing surfaces. Centrally of the bar a threaded opening 23 is provided which extends vertically through the bar with the threads being continuous from top to bottom of the bar. Each weld nut 20 is suitably attached to the outer surface of a tube portion 18 or 19, such as by welding, so that the outer end defining a bearing surface 22 of the weld nut is in close proximity with the outer end of the tube portion. The threaded opening 23 is placed in axial alignment with an unthreaded hole or aperture 24 formed in tube portions 18 or 19. A thumb screw 25 of known type is threadedly received in threaded opening 23 of the weld nut in alignment with aperture 24 in the tube portion.

With this arrangement, the thumb screw 25 may be threadedly advanced into the interior of the tube portion through the unthreaded aperture 24 to engage an inserted frame member as will be described, and may be threadedly retracted to be withdrawn from the interior of the tube portion so as to avoid interference with the insertion and removal of a cooperating frame member. Typical weld nuts 20 include weld location recesses 26 which are utilized for spot welding nuts 20 to a tube portion 18 or 19. Threaded opening 23 has good thread depth providing strong and secured threaded engagement with thumb screw 25 thus effectively retaining thumb screw 25 in operative position on each corner frame member during assembly and disassembly of a frame. The threaded depth is also a measure of the depth of the innermost bearing surface 22 of the weld nut which is of importance in connection with retaining effective operative functioning of hinge member 13 as will be discussed.

Screen 10 of FIG. 1 is completed with the provision of a screen material 27 which is suitably attached by ties 28 to frames 11 and 12. The screen or curtain 27 is preferably continuous as shown in FIG. 1 so as to eliminate any gap between the pivotally interconnected frames 11 and 12. Privacy or decorative screens may include curtain materials formed from vinyl or cloth which preferably are flame-retardant. For industrial purposes, such as welding, the material must be flame-retardant and examples of suitable material include canvas or duck, vinyl coated fabric and fiberglass textiles. The screen or curtain material 27 may be opaque or transparent as desired and may be provided with a transparent window area so that work being performed behind the same my be observed from the outside.

Each frame 11 and 12 is completed with the provision of straight tube sections 29 of varying length. FIGS. 2 through 6 illustrate the manner in which straight tubes 29 are aligned with tube portions 18 and 19 of each adjacent corner frame member and telescopically received in the outer end portions of each tube portion 18 and 19 in communication with weld nuts 20 and thumb screws 25 so that threaded advancement of thumb screws 25 will result in engagement of the telescoped ends of straight tubes 29 and retention of the tubes in tube portions 18 and 19 of the corner frame members. As previously described, threaded retraction of thumb screws 25 will release the telescoped ends of straight tubes 29 and the straight tubes and corner frame members may be readily disengaged. In this manner, any number of frames may be quickly assembled or disassembled. The use of thumb screws 25 eliminates the necessity to use tools. Thus, the frames of the present invention in disassembled form may be readily stored and transported.

The frame members may be coated, painted or chromed depending on the environment of use. By way of example only, 18 gauge steel tubing may be used with the corner frame members having an outside diameter of 1 inch. The straight tubes may have an outside diameter of $\frac{7}{8}$ of an inch. For adequate strength, the portions of the corner frame members receiving the telescoped ends of the straight tubes will preferably receive $3\frac{1}{2}$ inches of each end of straight tube, plus or minus $\frac{1}{8}$ of an inch.

Figure 3:
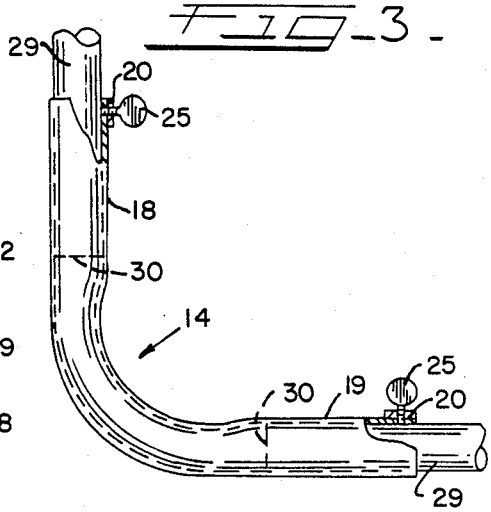
FIG. 3 is an enlarged fragmentary elevational view of one form of corner frame member of the present invention.

FIG. 3 illustrates one form of corner frame member 14 which may be used on every corner of a single frame as long as it is not necessary to support the same in elevated relation to the floor or other supporting surface, and as long as other suitable means are provided to maintain the screen in an upright position. In the screen illustrated in FIG. 1, corner frame member 14 is used solely to form the upper free corner of each screen 11 and 12. This is also the case in the three section screen illustrated in FIG. 2. In FIG. 3 the extent to which the free end of straight tubes 29 are inserted in the opposite ends of corner frame member 14 is best illustrated. The straight tube ends 30 are preferably received in corner frame member 14 to an extent of 3½ inches are previously described.

Figure 4:
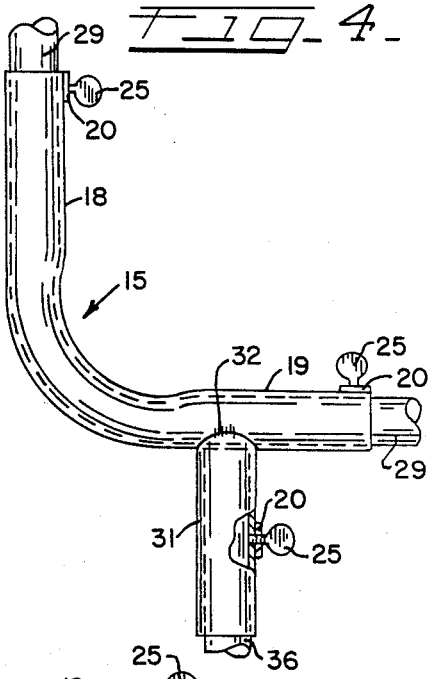
FIG. 4 is a view similar to FIG. 3 illustrating another form of corner frame member.

Corner frame member 15, best illustrated in FIG. 4, is of the same configuration as corner frame member 14, but includes a depending leg member 31. Leg member 31 is a short tubular section fastened by welds 32 of the horizontal leg portion 19 of corner frame member 15. Intermediate opposite ends of leg member 31, a weld nut 20 is attached to the outer surface. The threaded portion of the weld nut is in alignment with an unthreaded opening in leg member 31 through which thumb screw 25 may be advanced. Leg member 31 may be used as a supporting leg for a multi-section screen as shown in FIG. 1. When leg member 31 is used in this manner, a known form of plastic cap 33 may be inserted in the bottom end of each leg member to prevent marring of the supporting surface.

Alternatively, the multi-section screen of FIG. 2 illustrates the use of conventional platform legs 34 which are in the form of inverted T's having plastic caps 35 at the supporting ends thereof to protect the supporting surface. The upstanding leg portion 36 of each platform leg is telescopically received in leg member 31 of each corner frame member 15 as shown in FIGS. 2 and 4. Thumb screws 25 are threadedly advanced through weld nuts 20 to ultimately engage legs 36 and clamp the same to the frame section. Reversing the procedure provides for ready disassembly, transportation and storage of the related parts. Again, as is known, platform legs may be used which are provided with casters to permit ready movement of frame assemblies from one location to another. Casters may also be directly attached to leg members 31 of corner frame members 15.

One form of hinged corner frame member is shown in FIG. 1. This is an assembly of a pair of corner frame members 16 which are arranged with their upstanding tube portions 18 in side-by-side relationship with the double collar hinge assembly 13 interconnecting the same directly below or inwardly of weld nuts 20 and related thumb screws 25. The hinge assembly 13 consists of a pair of tube sections 37 of identical configuration which are interconnected by welds 38. By way of example, while the steel tubing of the corner frame members may be 1 inch in outside diameter, each hinge collar 37 may have an outside diameter of 1⅛ inches. Thus, upper tube portions 18 of corner frame member assembly 16 may freely rotate with their respective collars 37 to provide the multi-sectioned screen with pivoting action.

Each upper tube portion 18 of corner frame member assembly 16 is provided with a circumferentially continuous boss 39 which, as shown in FIG. 5, is located immediately below the bottom ends of hinge collars 37. In this manner hinge assembly 13 is confined between bosses 39 and bearing surfaces 22 of weld nuts 20. In manufacturing the hinged corner frame member assembly 16, hinge collar assembly 13 would be installed against bosses 39 before weld nuts 20 are welded to tube portions 18.

Preferably, the length of each hinge collar 37 will be such as to establish a total clearance of from 1/16 to 3/16 of an inch with respect to both the weld nuts and the bosses. The embossed area defining bosses 39 will preferably provide a height of from 1/32 to 1/16 of an inch. The sides of each boss should be 30 degrees or steeper so that hinge collars 37 will not bind on the bosses. As previously described, bearing surface 22 of the weld nuts have substantial height and, for this reason and also because of the convex shape of the surfaces, a low coefficient of friction is provided. While bosses 39 should preferably extend for 360 degrees, a lesser extent may be used. FIG. 5 illustrates that when tube portion 19 of corner frame member assembly 16 is pivoted outwardly into oppositely directed coplanar relation, weld nuts 20 and thumb screws carried by the upper ends of tube portions 18 are located to project oppositely outwardly. This arrangement eliminates any possibility of interferences between these parts when the tube portions of the frame member assembly are pivoted relative to one another.

Figure 6:
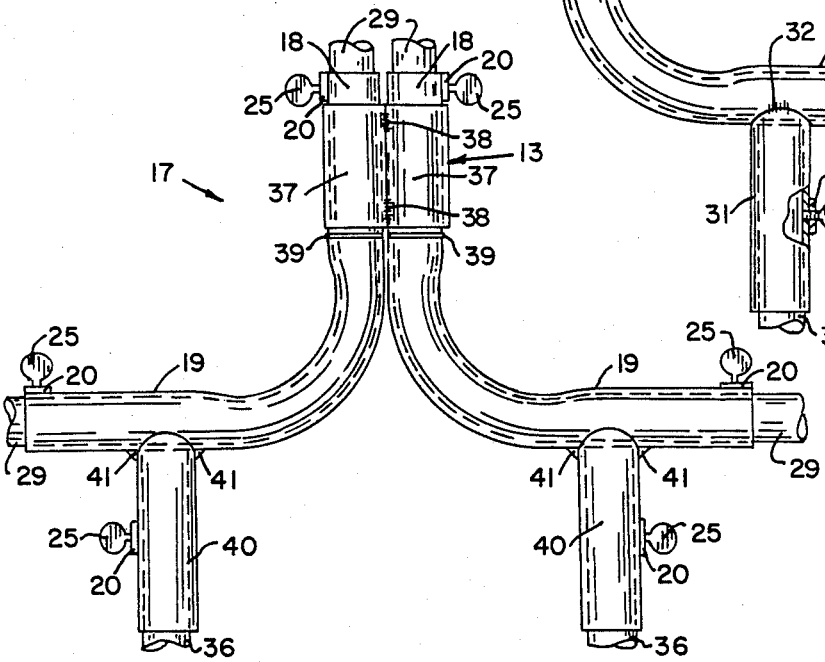
FIG. 6 illustrates the pivotal interconnection of a pair of corner frame members of the type illustrated in FIG. 4.

FIGS. 1 and 2 illustrate the utilization of the pivotal corner frame member assembly 16 to provide the upper pivoting action of adjacent frame sections. FIG. 6 illustrates a pivotal frame member assembly 17 which may be used at the lower portions of adjacent frame section corners. The assembly of FIG. 6 includes substantially the same form of double collar hinge interconnection as previously described in FIG. 5. The difference that resides in assembly 17 of FIG. 6 is the provision of a pair of depending leg members 40, which are of the same general construction as depending leg member 31 shown in FIG. 4 and which are intended to function in the same manner as described with respect to the embodiment of FIG. 4. Thus, leg members 40 may be utilized to support a screen directly on a supporting surface with the provision of non-marring plastic caps 33 as shown in FIG. 1, or may telescopically receive platform legs 36 as shown in FIG. 2. FIG. 6 illustrates the different placement of welds 41 as compared to the placement of welds 32 of FIG. 4. Welds 41 attach leg members 40 to tube portions 19 but are located in less visible areas. Such a location may be desirable when the features of the subject invention are incorporated in a space divider intended for non-industrial use.

While the particular corner frame member assembly 17 of FIG. 6 is not illustrated as a part of the screens of FIGS. 1 and 2, this particular assembly demonstrates the versatility of the subject design. Where desired, any one form of a corner frame member may be pivotally combined with another form of corner frame member to obtain a variety of desirable end results. Thus, it is seen that in FIG. 1 and 2 the lower pivotally interconnected corner frame member assemblies include combinations of the frame members 14 and 15 of FIGS. 3 and 4, respectively. The tubular construction of the subject space divider provides requisite strength without imparting undue weight. For industrial purposes, the frames may be provided with a black, non-glare finish. The hinge assemblies are manufactured economically, are durable and sturdy and are non-binding.

While particular embodiments of the invention have been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

I claim:

1. A space divider comprising:

at least a pair of frames formed from primary and secondary frame members, said primary frame members forming the corners of said frame and said secondary frame members at least interconnecting said primary frame members to complete each of said pair of frames;

said pair of frames being aligned in side-by-side relationship, each said primary frame member having threaded nut means attached to the external surface of said primary member, said nut means defining a raised bearing surface at an end thereof;

hinge means interconnecting pairs of primary frame members to permit pivoting of said pair of frames relative to each other, an end of said hinge means slidably engaging said raised bearing surface of said nut means; and said hinge means includes a double collar and has a collar section slidingly received about each of said pair of frames and between said raised bearing surface of said threaded nut means and an outwardly projecting bearing surface means of at least one of said frames, said bearing surface means and said nut means being on said frames in sufficiently spaced relation for receiving said collar section therebetween;

whereby said interconnected pair of primary frame members are freely rotatable relative to each other about said hinge means.

2. The space divider of claim 1, wherein said set screw is in the form of a thumb screw.

3. The space divider of claim 1, wherein said nut means are attached to each said primary frame member of said interconnected pair of primary frame members so that said nut means project in opposite directions and are oriented in a coplanar relation when said pair of primary frame members are pivoted into a coplanar relation, said coplanar relation between said nut means preventing relative interference of movement when said pair of primary frame members are rotated within said hinge means.

4. The space divider of claim 1, wherein said bearing surface is a boss which extends 360 degrees around said primary frame member.

5. The space divider of claim 4, wherein said nut means are attached to said primary frame member of said interconnected pair of primary frame members so that said nut means project in opposite directions and are oriented in a coplanar relation when said pair of primary frame members are pivoted into a coplanar relation, said coplanar relation between said nut means preventing relative interference of movement when said pair of primary frame members are rotated within said hinge means.

6. The space divider of claim 1, wherein the primary frame members defining the bottom corners of said frame are provided with depending leg members for elevation of said frame relative to a supporting surface.

7. The space divider of claim 6, wherein:

said leg memebers include threaded nut means affixed thereto;

openings through said leg members, said openings being in alignment with the threaded portion of said nut means associated with each said leg member to permit threadedly advanced communication of a set screw through said nut means and into the interior of said leg members to clamp a telescopically received leg portion within said leg member; and a set screw carried by said nut means.

8. The space divider of claim 1, wherein said bearing surface means is another nut means having a raised bearing surface.

9. A corner frame member for use in building a screen for sub-dividing space, said frame member comprising:

a tube having first and second tube portions positioned at right angles to one another;

an opening extending through the side wall of said tube adjacent opposite ends thereof;

a threaded nut fixed to outer surface portions of said tube surrounding each of said openings with the threaded portion of each nut in alignment with an opening, said threaded nut defining a bearing surface at an end thereof;

a thumb screw threadedly received in the threaded portion of each nut for advancement and retraction therethrough into and out of an aligned opening; and a hinge collar assembly slidingly received about said first tube portion, said hinge collar assembly being located adjacent to said threaded nut to slidably engage said bearing surface of said threaded nut.

10. The corner frame member of claim 9, wherein a tubular leg member depends from said second tube portion, said leg member being provided with an opening through the sidewall of said leg member, a threaded nut affixed to said leg member and aligned over said opening, and a thumb screw threadedly received within said threaded nut.

11. The corner frame members of claim 9, wherein:

a pair of frame members are aligned in side-by-side relationship with said first tube portions of said pair of frame members being arranged parallel to each other;

said hinge collar assembly hingedly interconnecting said parallel first tube portions of said pair of frame members; and a boss formed in said first tube portions and positioned thereon to confine said hinge means between said boss and said bearing surface for pivoting of said pair of frame members relative to each other.

12. The corner frame member of claim 11, wherein each said threaded nut is positioned on one of said frame members to project outwardly therefrom such that said threaded nut on said pair of frame members are oriented in a coplanar relation when said frame members are pivoted into a coplanar relationship, said coplanar relationship between said nut means preventing relative interference of movement when said pair of primary frame members are rotated within said hinge means.

13. The corner frame member of claim 11, wherein said boss extends 360 degrees around said first tube portion.

14. The corner frame members of claim 13, wherein a tubular leg member depends from said second tube portion, said leg member being provided with an opening through the sidewall of said leg member, a threaded nut affixed to said leg member and aligned over said opening, and a thumb screw threadedly received within said threaded nut.

15. The corner frame member of claim 14, wherein said threaded nuts are positioned on said pair of frame members to project outwardly such that said threaded nuts on said pair of frame members are oriented in a coplanar relation when said frame members are pivoted into a coplanar relationship, said coplanar relationship between said nut means preventing relationship interference of movement when said pair of primary frame members are rotated within said hinge means.

* * * * *

UNITED STATES PATENT AND TRADEMARK OFFICE

CERTIFICATE OF CORRECTION

PATENT NO. : 4,842,035

DATED : June 27, 1989

INVENTOR(S) : W. Owen Thompson

It is certified that error appears in the above-identified patent and that said Letters Patent is hereby corrected as shown below:

Title page:

After the title, "Inventor: Owen Thompson," should read --Inventor: W. Owen Thompson,--.

Column 2, line 66, "interconnecting" should read --interconnection--.

Column 6, line 3, "surface" should read --surfaces--.

Column 8, line 44, "nut" should read --nuts--; line 53, "members" should read --member--.

Signed and Sealed this

Tenth Day of July, 1990

*Attest:*

*Attesting Officer*

HARRY F. MANBECK, JR.

*Commissioner of Patents and Trademarks*